US008967897B2

(12) United States Patent
Apodaca et al.

(10) Patent No.: US 8,967,897 B2
(45) Date of Patent: Mar. 3, 2015

(54) COSMETIC DISPENSERS WITH A TRANSLUCENT WALL AND AN OPAQUE HOUSING

(75) Inventors: Adrian C. Apodaca, Santa Monica, CA (US); Timothy Thorpe, Santa Monica, CA (US)

(73) Assignee: HCT Asia Ltd, Central (HK)

( * ) Notice: Subject to any disclaimer, the term of this patent is extended or adjusted under 35 U.S.C. 154(b) by 975 days.

(21) Appl. No.: 13/048,651

(22) Filed: Mar. 15, 2011

(65) Prior Publication Data

US 2012/0237281 A1 Sep. 20, 2012

(51) Int. Cl.

| | |
|---|---|
| ***B43M 11/06*** | (2006.01) |
| ***A45D 34/04*** | (2006.01) |
| ***A45D 40/24*** | (2006.01) |
| *A45D 34/00* | (2006.01) |

(52) U.S. Cl.

CPC ..... *A45D 34/04* (2013.01); *A45D 40/24* (2013.01); *A45D 2034/007* (2013.01); *A45D 2200/053* (2013.01); *A45D 2200/056* (2013.01)

USPC ..... 401/184; 401/183; 401/192

(58) Field of Classification Search

USPC ..... 401/183–186, 192

See application file for complete search history.

(56) References Cited

U.S. PATENT DOCUMENTS

| | | | | | |
|---|---|---|---|---|---|
| 753,968 | A * | 3/1904 | Farmer | 401/184 |
| 776,468 | A * | 11/1904 | Hosmer | 401/184 |
| 1,030,440 | A * | 6/1912 | Waterman | 401/186 |
| 1,170,923 | A * | 2/1916 | Malkin | 401/183 |
| 2,321,265 | A * | 6/1943 | Ulvick | 401/184 |
| 3,734,106 | A * | 5/1973 | Zimmerman | 401/183 |
| 6,672,784 | B2 * | 1/2004 | Baumann et al. | 401/183 |
| 6,789,974 | B2 * | 9/2004 | Atkinson et al. | 401/183 |
| 7,108,441 | B2 * | 9/2006 | Altonen et al. | 401/192 |
| 7,419,323 | B1 * | 9/2008 | Zhang | 401/186 |
| 7,461,993 | B1 * | 12/2008 | Sampaio | 401/183 |
| 7,677,827 | B1 * | 3/2010 | Manukian | 401/186 |
| 7,854,562 | B2 * | 12/2010 | Peterson et al. | 401/183 |
| 7,878,727 | B2 * | 2/2011 | Koptis | 401/126 |
| 8,517,622 | B2 * | 8/2013 | Apodaca et al. | 401/183 |
| 8,540,449 | B2 * | 9/2013 | Song | 401/183 |
| 8,714,857 | B1 * | 5/2014 | Liu | 401/183 |
| 2004/0114988 | A1 * | 6/2004 | Baumann et al. | 401/183 |
| 2005/0286967 | A1 * | 12/2005 | Blauzdys | 401/185 |
| 2006/0222451 | A1 * | 10/2006 | Glassman | 401/183 |
| 2013/0108350 | A1 * | 5/2013 | Ulrich et al. | 401/183 |

* cited by examiner

*Primary Examiner* — David Walczak
*Assistant Examiner* — Bradley Oliver
(74) *Attorney, Agent, or Firm* — Lee & Hayes, PLLC

(57) ABSTRACT

A cosmetic dispenser includes a translucent reservoir sandwiched in-between a shelled wall and a solid wall of an opaque housing. The shelled wall provides exposure to a portion of the translucent reservoir, the exposed portion of the translucent reservoir defines a flexible wall. The translucent reservoir being formed of a substantially more supple material than the opaque housing, thereby providing the flexible wall to displace a portion of product stored in the translucent reservoir.

22 Claims, 7 Drawing Sheets

COSMETIC DISPENSERS WITH A TRANSLUCENT WALL AND AN OPAQUE HOUSING

BACKGROUND

Devices exist for storing cosmetic or medicinal products. Such devices usually consist of a housing and/or a reservoir, a delivery mechanism for displacement of the cosmetic or medicinal products, and an applicator tip. For example, in the medical industry, dispensers are employed for applying medicinal products, such as ointments, to portions of the body. In the cosmetics and personal care industries, dispensers are used to apply lipstick, lip balm, skin creams, lotions, and other cosmetic products to portions of the body.

SUMMARY

This summary is provided to introduce simplified concepts of cosmetic dispensers with a translucent wall and an opaque housing, which are further described below in the Detailed Description. This summary is not intended to identify essential features of the claimed subject matter, nor is it intended for use in determining the scope of the claimed subject matter.

This disclosure is directed to dispensers with a translucent wall opposite an opaque solid wall. The translucent wall may be a wall of a single unitary flexible reservoir. The opaque solid wall may be a wall of a single unitary inflexible housing having a shelled wall opposite the opaque solid wall.

In one implementation, the single unitary flexible reservoir may be sandwiched in-between the shelled wall and the opaque solid wall of the inflexible housing. The shelled wall may provide exposure to a portion of the flexible reservoir defining a flexible wall configured to displace a portion of a product stored in the flexible reservoir.

In some implementations, a collar may be fixed distal to the inflexible housing. The collar may be ultrasonically welded to the inflexible housing and may contain the flexible reservoir in the inflexible housing.

In some implementations, the dispensers may be manufactured by sandwiching the flexible reservoir in-between the shelled wall and the solid wall of the inflexible housing. The manufacturing of the dispensers may include fixing the collar distal to the inflexible housing. The reservoir may comprise a plastic, or any other soft malleable suitable material. Likewise the housing may comprise a plastic, a metal, a glass or any other suitable hard nonmalleable material. As used herein, translucent materials are those that allow passage of light, and may include materials that are transparent, clear, colorless, or tinted, as long as they allow passage of a substantial amount of light so that a product is visible through the material of the reservoir.

In some implementations, an application tip may be securely disposed to the collar. The application tip may include a product delivery duct. The product delivery duct may interconnect the reservoir contained in the inflexible housing to the application tip for dispensing product stored in the reservoir.

In some implementations, the dispensers may comprise an opaque flexible wall opposite an opaque solid wall. The opaque flexible wall may be a wall of a single unitary opaque flexible reservoir. The opaque solid wall may be a wall of a single unitary inflexible housing having a shelled wall opposite the opaque solid wall.

In some implementations, the dispensers may comprise a multi-chambered flexible reservoir arranged in the single unitary inflexible housing having a shelled wall opposite the opaque solid wall.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

This disclosure is directed to dispensers with a translucent wall and an opaque housing. The translucent wall is flexible and the opaque housing is inflexible. The flexible translucent wall is able to displace a portion of a product stored in a reservoir. In reservoir. While the translucent wall may be transparent, clear, colorless, tinted, or the like, the wall may be opaque. For example, rather than the flexible wall being transparent and allowing passage of a substantial amount of light so that a product is visible through the material of the reservoir, the flexible wall may be opaque and not allow passage of a substantial amount of light so that a product is not visible through the material of the reservoir. Further, and in this implementation, the opaque flexible wall may be the same or different color as a color of a product contained in the reservoir. The dispensers may have an opaque housing comprising a shelled wall opposite an inflexible solid wall. The opaque housing may comprise various plastics, metals, ceramics, or composites. The dispensers may have a flexible reservoir sandwiched between the shelled wall and the inflexible solid wall of the opaque housing. The flexible reservoir may comprise various plastics, ceramics, or composites. For example, the opaque housing and flexible reservoir may be formed of plastics and may be subsequently assembled together. Additionally, product may be dispensed from the dispenser through a product delivery duct disposed in an application tip for application of the product to a user's skin. In some implementations, the translucent wall may be substantially clear or tinted and therefore a color of the product contained in the reservoir may be observed before application. Moreover, the translucent wall of the dispenser may comprise a substantially more supple material than the opaque housing, thereby providing a deformable wall to displace a portion of product stored in the flexible reservoir.

Illustrative Dispenser with Translucent Wall and Opaque Housing

Figure 1:
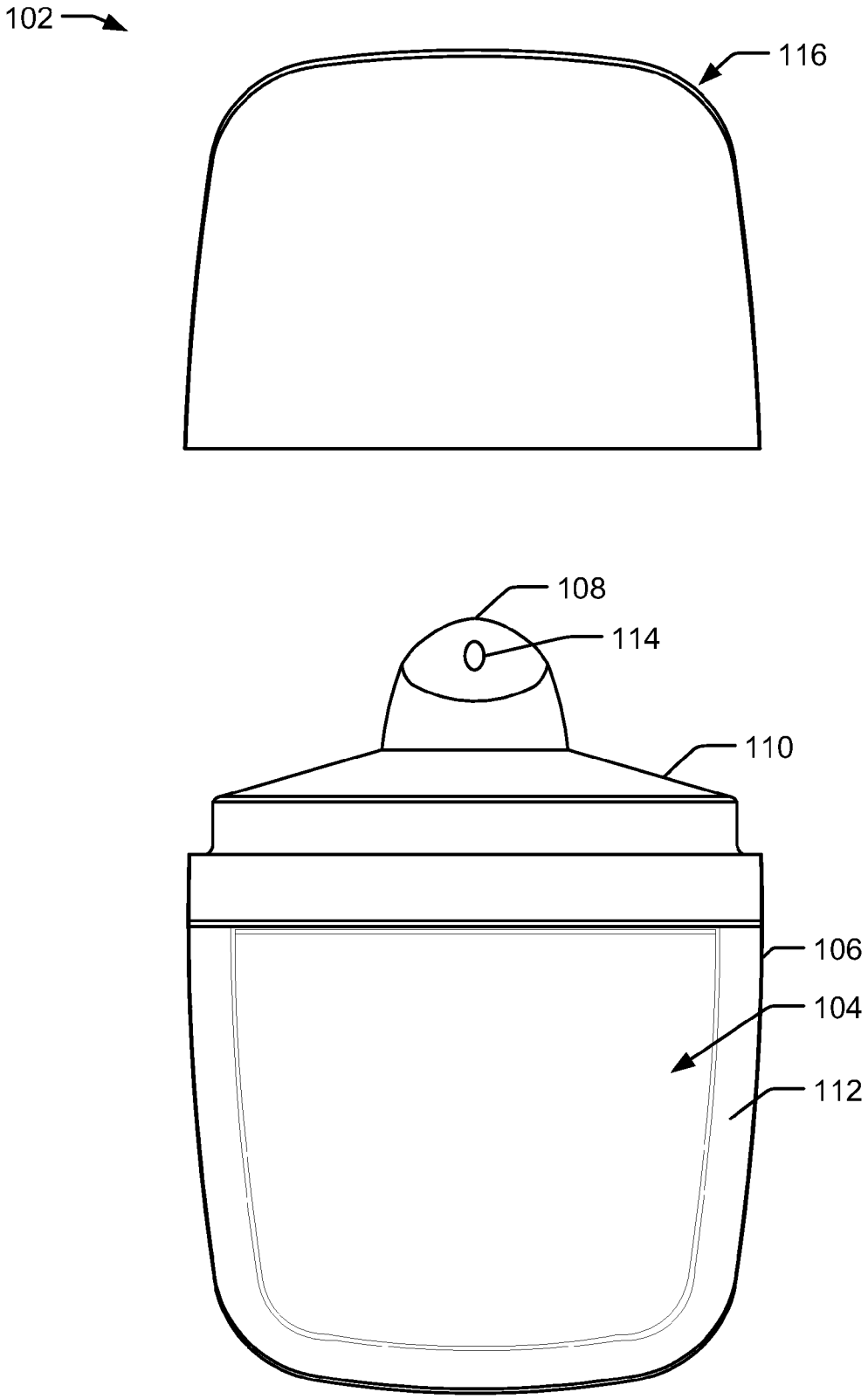
FIG. 1 illustrates a front view of a cosmetic dispenser comprising a translucent flexible wall and an opaque housing.

FIG. 1 represents an illustrative dispenser 102 with a translucent wall 104 and an opaque housing 106. The dispenser 102 comprises an application tip 108 securely disposed to a collar 110. FIG. 1 illustrates the collar 110 may be fixed distal to the opaque housing 106. The collar 110 may be made of a thermoplastic polymer or any other material which may be fixed to the opaque housing 106, such as various metals, plastics, ceramics, composites, or the like. In some embodiments, the opaque housing 106 may comprise terpolymer (e.g., DuPont™ Surlyn®), polypropylene (PP), acrylonitrile butadiene styrene (ABS), styrene acrylonitrile (SAN), acrylic, thermoplastic polyesters (e.g., polycyclohexlandymethanol terephthalate—PCT, PCTA, PCTG), Polymethyl methacrylate (PMMA), or other opaque materials. In some embodiments, the translucent wall 104 may comprise terpolymer (e.g., DuPont™ Surlyn®), polyethylene (PE), PP, polyethylene terephthalate (PET), PET modified by copolymerization (PETG), or other translucent materials. In the embodiment of FIG. 1, the opaque housing 106 comprises a generally pouch-shaped body having a shelled wall 112 formed therein. In this embodiment, the shelled wall 112 formed in the pouch-shaped body of the opaque housing 106 provides exposure to a portion of a flexible reservoir contained in the opaque housing 106. The exposed portion of the flexible reservoir defines the translucent wall 104. For example, the flexible reservoir may comprise terpolymer (e.g., DuPont™ Surlyn®), PE, PP, PET, PETG, or other flexible materials suitable for forming the translucent wall 104. Further, the flexible material forming the translucent wall 104 may force product to the application tip 108 via a product delivery duct 114. The product delivery duct 114 may be interconnected with the flexible reservoir and may transport displaced product stored in the flexible reservoir to the application tip 108.

The dispenser 102 also includes a cap 116 that encapsulates the application tip 108 when the dispenser 102 is not in use. The cap 116 may be made of a thermoplastic polymer or any other material which is non-reactive or resistant to the product being dispensed, such as various metals, plastics, ceramics, composites, or the like. The cap 116 may be substantially the same shape as the opaque housing 106. For example, the cap 116 may be substantially the same shape as the generally pouch-shaped opaque housing 106. The dispenser 102 is shown as being a generally a pouch-shaped body. However, in other implementations, the dispenser may be configured in any form suitable for dispensing a portion of the product contained in the flexible reservoir. For example, the dispenser 102 may be a generally tubular shaped body. Likewise, a tubular shaped flexible reservoir may be contained by an inflexible housing. Further, the inflexible housing may be tubular shaped. The tubular shaped inflexible housing may also have a shelled wall 112 formed therein, which provides exposure to a portion of the tubular shaped flexible reservoir.

Figure 2B:
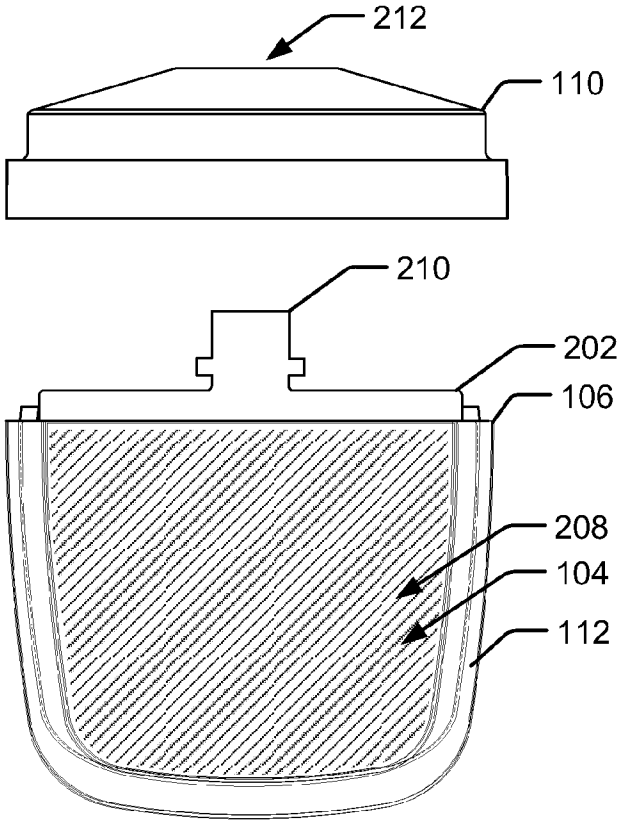
FIGS. 2A-2D illustrate a construction of the cosmetic dispenser of FIG. 1.
Figure 2A:
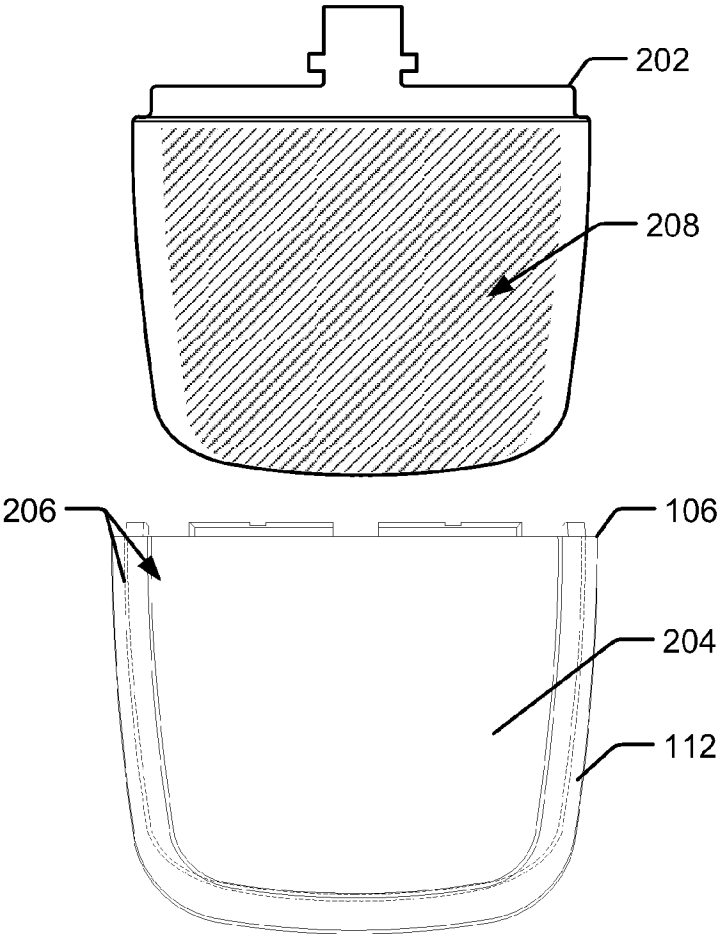

FIGS. 2A-2D illustrate a construction of the dispenser 102 of FIG. 1. FIG. 2A illustrates a flexible reservoir 202 configured to be contained by the opaque housing 106. As discussed above, the flexible reservoir 202 may comprise terpolymer (e.g., DuPont™ Surlyn®), PE, PP, PET, PETG, or other flexible materials suitable for storing a product. The flexible reservoir 202 may be translucent, clear, tinted, or any other level of transparency suitable for providing visibility to a product stored in the flexible reservoir 202. Further, the flexible reservoir may be opaque and may be the same or different as the color of a product stored in the flexible reservoir. While FIG. 2A illustrates the flexible reservoir 202 as comprising a single chamber, the flexible reservoir may comprise any number of chambers. For example, a flexible reservoir may comprise two separate and distinct chambers for storing cosmetic product. For example, each chamber may hold a different type of cosmetic product. FIG. 2A illustrates that the opaque housing 106 comprises the shelled wall 112 opposite a solid wall 204, which may be a single unit of material. For example, the opaque housing 106 may be formed as a single unit from terpolymer, polypropylene (PP), acrylonitrile butadiene styrene (ABS), styrene acrylonitrile (SAN), acrylic, thermoplastic polyesters (e.g., polycyclohexlandymethanol terephthalate—PCT, PCTA, PCTG), Polymethyl methacrylate (PMMA), or other opaque materials. The shelled wall 112 opposite the solid wall 204 defines a cavity 206 for containing the flexible reservoir 202 in the opaque housing 106. For example, the shelled wall 112 and the solid wall 204 may sandwich the flexible reservoir 202 in-between the shelled wall 112 and the solid wall 204.

FIG. 2B illustrates the flexible reservoir 202 sandwiched in-between the shelled wall 112 and the solid wall 204 of the opaque housing 106. The shelled wall 112 formed in the opaque housing 106 provides exposure to a portion 208 of the flexible reservoir 202 contained in the opaque housing 106. The exposed portion 208 of the flexible reservoir 202 may define the translucent wall 104. FIG. 2B illustrates the collar 110 for containing the flexible reservoir 202 in the cavity 206 of the opaque housing 106. The collar 110 may be opaque and may be formed as a single unit from terpolymer, polypropylene (PP), acrylonitrile butadiene styrene (ABS), styrene acrylonitrile (SAN), acrylic, thermoplastic polyesters (e.g., polycyclohexlandymethanol terephthalate—PCT, PCTA, PCTG), Polymethyl methacrylate (PMMA), or other opaque materials. While FIG. 2B illustrates the collar 110 being a separate unit from the housing 106, the collar 110 and the housing 106 may be formed as a single unit from terpolymer, PP, ABS, SAN, polyesters (e.g., PCT, PCTA, PCTG), or other opaque materials. For example, the collar 110 may be connected to the housing 106 via a living hinge. The collar 110 may be fixed distal to the opaque housing 106. For example, the collar 110 may be ultrasonically welded, adhesively adhered, mechanically fastened (e.g., press-fit, snap-fit, interference fit, threads, or fastener) and/or engaged by one or more engagement features, distal to the opaque housing 106. The collar 110 may encapsulate a coupling 210 of the flexible reservoir 202 and may have an opening 212 for receiving a portion of the application tip 108. The collar 110 may be configured to support application tip 108 that may be interconnected to the flexible reservoir 202.

Figure 2D:
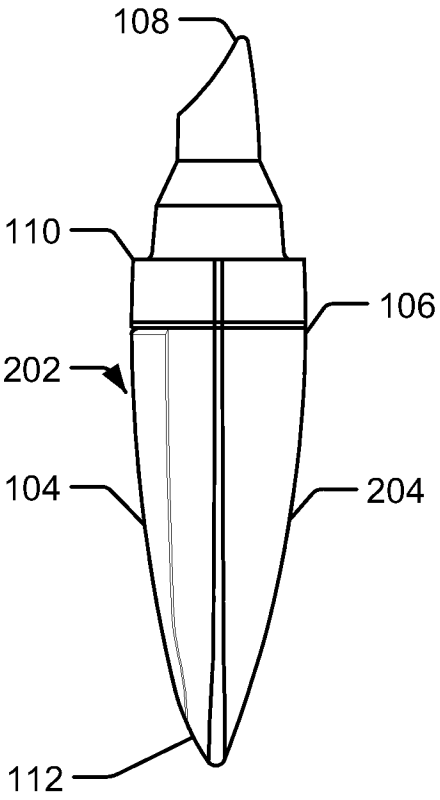
Figure 2C:
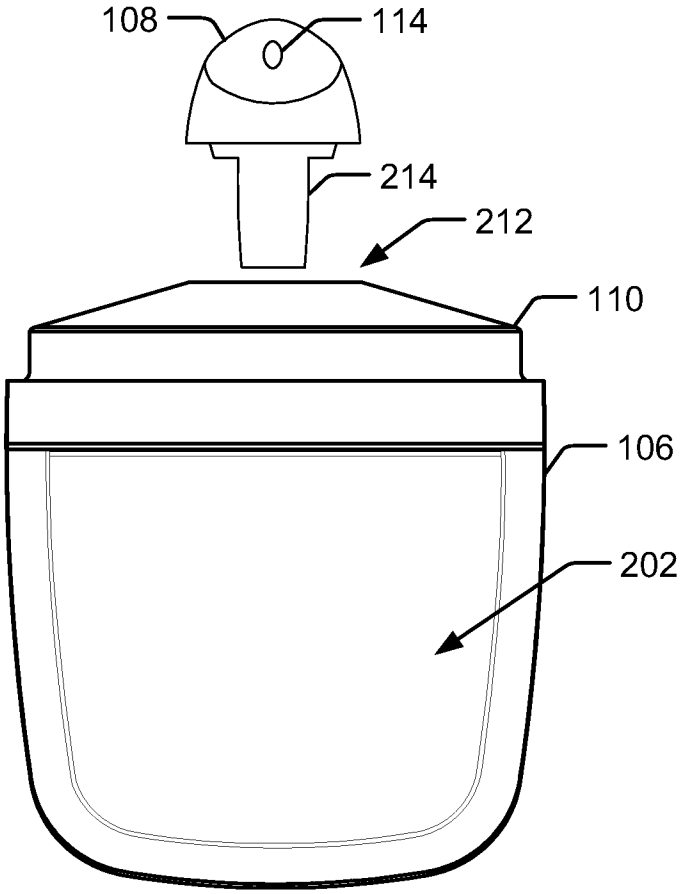

FIG. 2C illustrates the application tip 108 having a stem 214 for interconnecting with the coupling 210 of the flexible reservoir 202. The stem 214 may transport a displaced portion of product stored in the flexible reservoir 202 to the application tip 108. While FIG. 2C illustrates the application tip 108 being a separate unit from the collar 110, the application tip 108 and the collar 110 may be formed as a single unit from terpolymer, PP, ABS, SAN, polyesters (e.g., PCT, PCTA, PCTG), or other opaque materials. For example, the application tip 108, collar 110, and the housing 106 may be molded as one unit. As discussed above, and in this implementation, the collar having the application tip formed therein may be connected to the housing via the living hinge.

FIG. 2D illustrates a side view of the assembled dispenser 102 without the cap 116. As FIG. 2D illustrates, the dispenser 102 may comprise a generally pouch-shaped body. Again, in this embodiment, the shelled wall 112 formed in the generally pouch-shaped body of the opaque housing 106 provides exposure to a portion 208 of the flexible reservoir 202. The exposed portion 208 of the flexible reservoir 202 may define the translucent wall 104. FIG. 2D further illustrates that the shelled wall 112 may be opposite to the solid wall 204. As discussed above, the shelled wall 112 opposite to the solid wall 204 may be made of a material different than the material of the flexible reservoir 202. For example, the flexible reservoir 202 may comprise any flexible materials suitable for forming the translucent wall 104, and the shelled wall 112 and the solid wall 204 may comprise any inflexible materials suitable for forming the opaque housing 106. Further, the inflexible material forming the shelled wall 112 and the solid wall 204 may provide for deforming the translucent wall 104, but not the inflexible solid wall 204. Because the inflexible solid wall 204 does not deform, the translucent wall 104 deforms and displaces a portion of product stored in the flexible reservoir 202.

Figure 3:
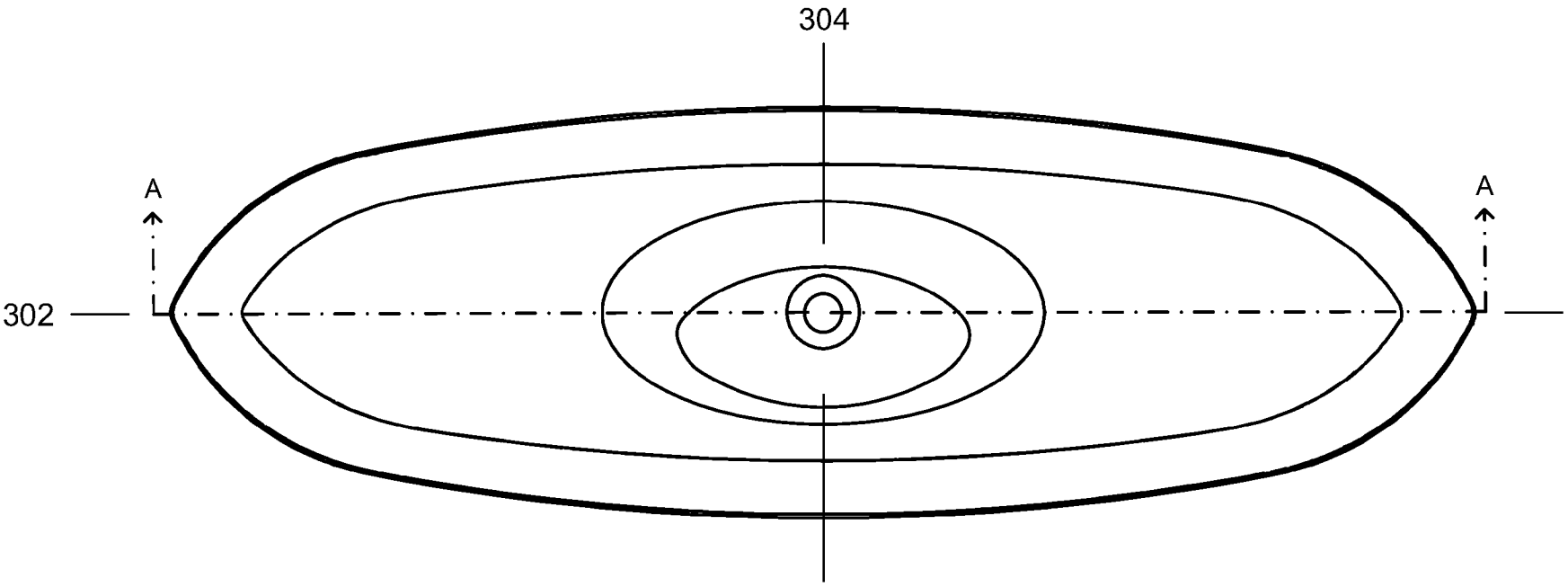
FIG. 3 illustrates a top view of the cosmetic dispenser shown in FIG. 1.

FIG. 3 is a top view of the dispenser 102 without the cap 116. Again, the dispenser 102 generally comprises a pouch-shaped body. In this implementation the dispenser 102 is shown as being generally symmetric about a longitudinal axis 302 and a latitudinal axis 304.

Figure 4:
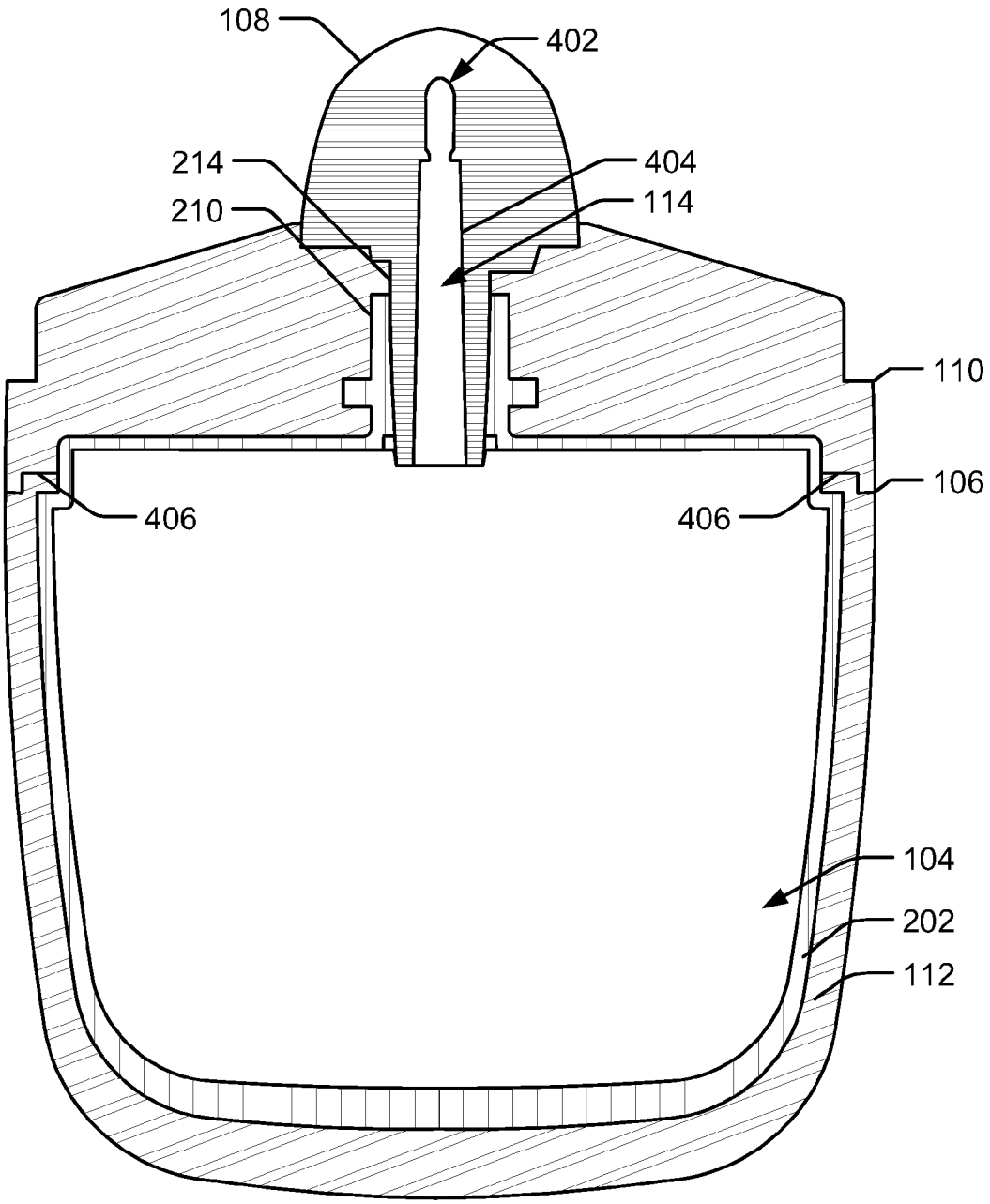
FIG. 4 illustrates a cross-section of the dispenser taken along line A-A illustrated in FIG. 3 and illustrates details of interconnection of the flexible reservoir and the application tip.

FIG. 4 illustrates a cross-section of the dispenser 102 without the cap 116 taken along line A-A illustrated in FIG. 3 and illustrates details of interconnection of the flexible reservoir 202 and the application tip 108. In the illustrated implementation, the opaque housing 106 comprises the shelled wall 112 configured to surround and hold the flexible reservoir 202. Again, the shelled wall 112 provides exposure to the portion 208 of the flexible reservoir 202, the exposed portion 208 of the flexible reservoir 202 defining the translucent wall 104. The translucent wall 104 is configured to displace a portion of a product stored in the flexible reservoir 202 into the product delivery duct 114 and to the application tip 108.

As illustrated in FIG. 4, the flexible reservoir 202 is interconnected to application tip 108 via the product delivery duct 114. FIG. 4 illustrates that the product delivery duct 114 may comprise an aperture 402 and bore 404. Bore 404 may extend longitudinally through application tip 108 and stem 214. The stem 214 may be received by the coupling 210 of the flexible reservoir 202. With the stem 214 securely coupled to the coupling 210 of the flexible reservoir, the product delivery duct 114 may be able to transport product from the flexible reservoir 202 through the product delivery duct 114 to the application tip 108, when the exposed translucent wall 104 of flexible reservoir 202 is displaced.

FIG. 4 illustrates that the collar 110 may be fixed distal to the opaque housing 106. As discussed above with respect to FIG. 2B, the collar 110 may be fixed distal to the opaque housing 106 via an ultrasonic welding process. The collar 110 may be ultrasonically welded to the opaque housing at an interface 406. Again, because the collar 110 may be fixed to the opaque housing, the collar 110 may contain the flexible reservoir 202 in the cavity 206 of the opaque housing 106.

Figure 5:
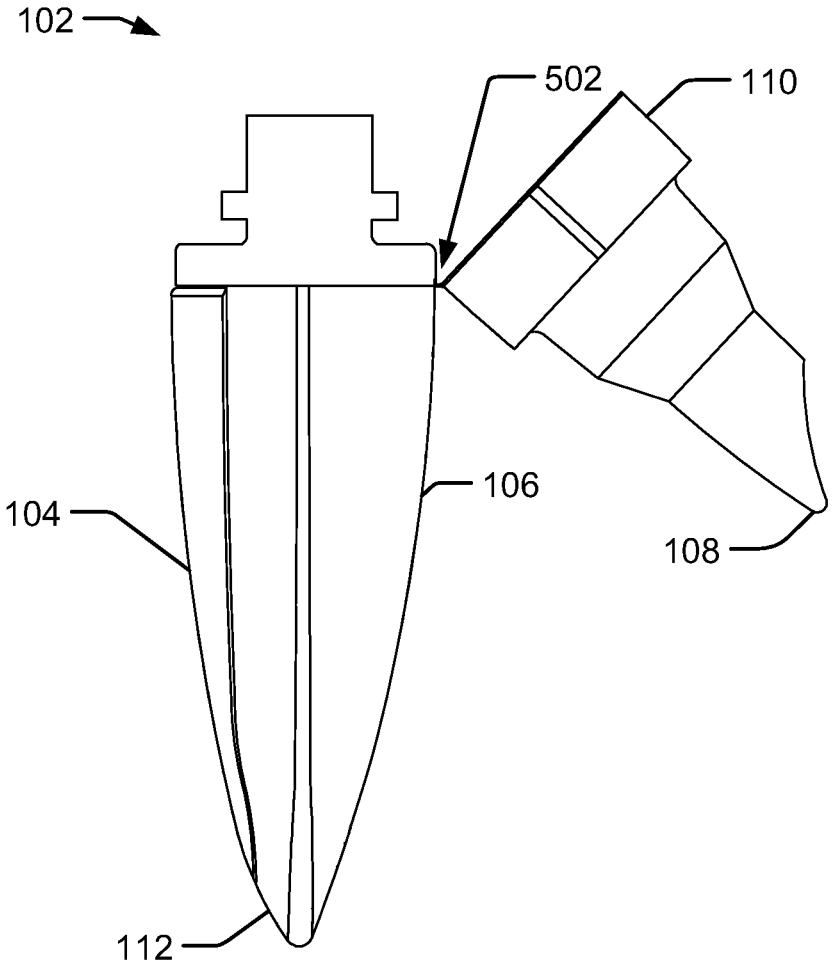
FIG. 5 illustrates a cosmetic dispenser comprising a living hinge coupling a collar and a housing.

FIG. 5 illustrates a dispenser 102 comprising a living hinge 502 coupling a collar 110 and a housing 106. As discussed above, with respect to FIG. 1, FIG. 5 illustrates dispenser 102 with a translucent wall 104 and an opaque housing 106. The dispenser 102 comprises an application tip 108 securely disposed to the collar 110. In the embodiment of FIG. 5, the collar 110 may be connected to the opaque housing 106 via the living hinge 502. While FIG. 5 illustrates the collar 110 may be connected to the opaque housing 106 via a living hinge 502, any other hinge may be utilized. For the hinge connecting the collar 110 and the housing 106 may be a barrel hinge, pivot hinge, butt/mortise hinge, case hinge, continuous hinge, concealed hinge, butterfly hinge, flag hinge, strap hinge, H hinge, HL hinge, or the like. The living hinge 502 may provide for the collar 110 to be pivotably rotated into position such that the collar 110 is positioned distal to the housing 508. The application tip 108 and the collar 110 may be molded as one unit. Further, the application tip 108, collar 110, and the housing 106 may be molded as one unit.

Figure 6:
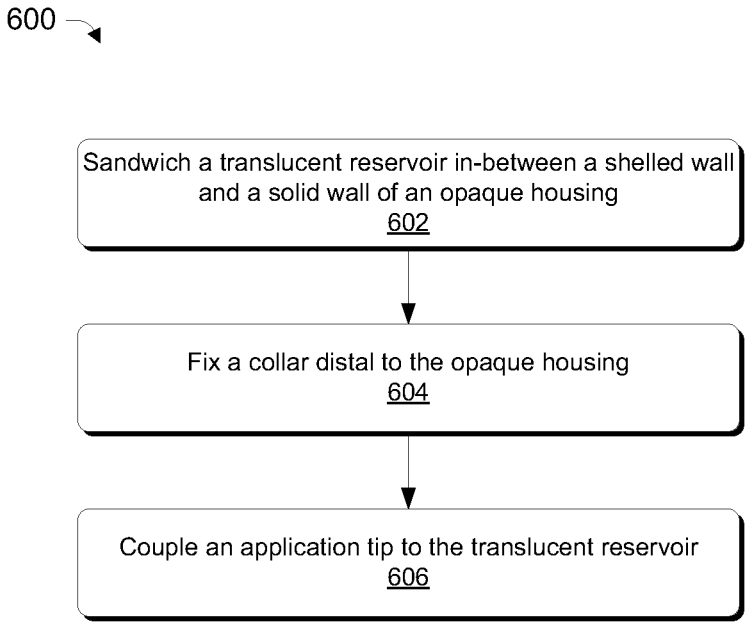
FIG. 6 illustrates an example process for manufacturing a cosmetic dispenser comprising a translucent flexible wall and an opaque housing.

Example Process for Manufacturing a Dispenser with Translucent Wall and Opaque Housing FIG. 6 illustrates an example process 600 for manufacturing a cosmetic dispenser (e.g., dispenser 102) comprising a translucent reservoir (e.g., flexible reservoir 202) and an opaque housing (e.g., opaque housing 106) based at least in part on material characteristics of the particular cosmetic dispenser. For instance, this process may be performed to manufacture a cosmetic dispenser comprising a translucent reservoir formed of a first material and an opaque housing formed of a second material different from the first material. For example, the first material forming the translucent reservoir may be terpolymer (e.g., DuPont™ Surlyn®), PE, PP, PET, PETG, or other translucent materials, and the second material forming the opaque housing may be terpolymer, PP, ABS, SAN, acrylic, thermoplastic polyesters (e.g., PCT, PCTA, PCTG), PMMA, or other opaque materials. In some instances, the process may be performed at a manufacturing facility during an assembly of the cosmetic dispenser. Specifically, the process may be performed at a manufacturing facility subsequent to a manufacturing of the translucent reservoir and the opaque housing. For example, the translucent reservoir may be formed by an extrusion blow molded (EBM) process at one manufacturing facility and the opaque housing may be formed by an injection molding process at a second manufacturing facility, different from the first manufacturing facility. The translucent reservoir and the opaque housing may then be assembled at a third manufacturing facility, different from the first manufacturing facility and the second manufacturing facility. Alternatively, the translucent reservoir and the opaque housing may be manufactured by a single manufacturing facility. Further, while a third manufacturing facility may assemble the translucent reservoir and the opaque housing together, a single manufacturing facility may manufacture the translucent reservoir and the opaque housing, and subsequently assemble the translucent reservoir and the opaque housing together. Further, it is contemplated that the translucent reservoir may be formed by other manufacturing processes other than an EBM process. For example, the translucent reservoir may be generally tube shaped and formed by an injection blow molding process. Here, the generally tube shaped reservoir may comprise a single layer or any number of layers of material. Specifically, the generally tube shaped reservoir may comprise one, two, three, four, or five layers of material formed by an extrusion process (e.g., a multilayer profile extrusion/co-extrusion process). The opaque housing may comprise a shelled wall (e.g., shelled wall 112) opposite a solid wall (e.g., solid wall 204). The shelled wall opposite the solid wall may define a cavity (e.g., cavity 206) for sandwiching the translucent reservoir in-between the shelled wall and the solid wall of the opaque housing.

While FIG. 6 illustrates a process for manufacturing a cosmetic dispenser with a translucent reservoir and an opaque housing configured to store and subsequently dispense a product to a surface, this process may apply to the manufacturing of any type of dispenser. Additionally, this process may apply to manufacturing any type of dispenser formed of any other suitable materials capable of storing a product and subsequently dispensing the product stored therein.

Process 600 includes an operation 602, which represents sandwiching the translucent reservoir in-between the shelled wall and the solid wall of the opaque housing. For example, the translucent reservoir may be inserted into the cavity of the opaque housing by sliding the translucent reservoir in-between the shelled wall and the solid wall of the opaque housing. Process 600 may include operation 604, where subsequent to at least the sandwiching of the translucent reservoir in-between the shelled wall and the solid wall of the opaque housing, a collar may be fixed distal to the opaque housing. The collar may be fixed distal to the opaque housing via an ultrasonic welding process. For example, the collar may be arranged distal to the opaque housing and subsequently ultrasonically welded to the opaque housing at an interface (e.g., interface 406).

Following operation 604, at operation 606, and subsequent to the fixing of the collar distal to the opaque housing, an application tip (e.g., application tip 108) may be securely coupled to the translucent reservoir. By securely coupling the application tip to the translucent reservoir, the application tip may secure the assembly of the cosmetic dispenser. For example, a stem (e.g., stem 214) of the application tip may be securely coupled to a reservoir coupling (e.g., coupling 210) of the translucent reservoir. In addition, the collar may support the application tip interconnected to the translucent reservoir. Further, in the embodiment illustrated in FIG. 5 where the collar may be connected to the opaque housing via a living hinge (e.g., living hinge 502), the collar may be pivoted, via the living hinge, to be arranged distal to the opaque housing. As discussed above, in this embodiment, the collar may include the application tip, where the collar and the tip are formed of a single unit. Here, in this embodiment, subsequent to the collar pivoting about the living hinge and arranged distal to the opaque housing, the collar may be ultrasonically welded, adhesively adhered, mechanically fastened (e.g., press-fit, snap-fit, interference fit) and/or engaged by one or more engagement features, distal to the opaque housing.

CONCLUSION

Although the invention has been described in language specific to structural features and/or methodological acts, it is to be understood that the invention is not necessarily limited to the specific features or acts described. Rather, the specific features and acts are disclosed as illustrative forms of implementing the invention. For example, while embodiments are described having a translucent reservoir sandwiched in-between a shelled wall and a solid wall of an opaque housing, other configurations are also contemplated. For example, a translucent window may be sealed to the shelled wall rather than sandwiching a translucent reservoir in-between the shelled wall and the solid wall. Additionally, for example, the translucent window sealed to the shelled wall may comprise various flexible plastics. In one specific example, a translucent window formed of a flexible plastic may be ultrasonically welded to the shelled wall of the opaque housing.

What is claimed is:

1. A cosmetic dispenser comprising:

a housing having a shelled wall opposite an inflexible solid wall;

a flexible reservoir having a coupling, the flexible reservoir sandwiched between the shelled wall and the inflexible solid wall of the housing, the shelled wall for providing exposure to a portion of the flexible reservoir, the exposed portion of the flexible reservoir defining a flexible wall for displacing a portion of a product stored in the flexible reservoir, and the coupling of the flexible reservoir protruding out a distance past the housing;

an inflexible collar fixed to the housing, the inflexible collar receiving at least a portion of the coupling of the flexible reservoir and containing the flexible reservoir in the housing; and an application tip having a stem interconnected with the coupling of the flexible reservoir, the interconnected stem and coupling for transporting the displaced portion of the product stored in the flexible reservoir to the application tip, and the inflexible collar supporting the application tip.

2. The cosmetic dispenser of claim 1, wherein the housing is opaque and the flexible reservoir is translucent.

3. The cosmetic dispenser of claim 2, wherein the housing is made of a material different than a material of the flexible reservoir.

4. The cosmetic dispenser of claim 2, wherein the housing comprises terpolymer, polypropylene (PP), acrylonitrile butadiene styrene (ABS), or styrene acrylonitrile (SAN).

5. The cosmetic dispenser of claim 2, wherein the flexible reservoir comprises terpolymer.

6. The cosmetic dispenser of claim 1, further comprising:

a cap removably coupled to the inflexible collar and encapsulating the application tip.

7. The cosmetic dispenser of claim 6, wherein the housing is generally pouch-shaped.

8. The cosmetic dispenser of claim 7, wherein the cap is substantially the same shape as the generally pouch-shaped housing.

9. The cosmetic dispenser of claim 1, wherein the flexible reservoir is generally pouch-shaped.

10. The cosmetic dispenser of claim 9, wherein the flexible reservoir is substantially clear.

11. The cosmetic dispenser of claim 9, wherein the flexible reservoir is tinted.

12. The cosmetic dispenser of claim 9, wherein the flexible reservoir is opaque.

13. The cosmetic dispenser of claim 1, wherein the flexible reservoir is generally tubular shaped.

14. A dispenser housing comprising:

a reservoir for storing a cosmetic product, the reservoir having a coupling extending a distance from the reservoir;

a shelled wall opposite a solid wall, the shelled wall and the solid wall forming a single unit having a cavity to retain the reservoir, the shelled wall for providing exposure to a portion of the reservoir, the exposed portion of the reservoir defining a flexible wall for displacing a portion of a product stored in the reservoir;

a collar fixed to the single unit, the collar receiving at least a portion of the coupling of the reservoir and retaining the reservoir in the cavity, an application tip securely coupled on the collar, the application tip having a stem interconnected with the coupling of the reservoir, and wherein the collar supports the application tip.

15. The dispenser housing of claim 14, wherein the reservoir is generally pouch-shaped and is formed by an extrusion blow molded (EBM) process.

16. The dispenser housing of claim 14, wherein the reservoir is generally tubular shaped and is formed by a multilayer profile extrusion/co-extrusion process.

17. The dispenser housing of claim 14, wherein the collar is fixed to the single unit via ultrasonic welding.

18. The dispenser housing of claim 14, wherein the collar is connected to the single unit via a living hinge.

19. A method comprising:

sandwiching a translucent reservoir formed of a first material in-between a shelled wall and a solid wall of an opaque housing formed of a second material different than the first material, the translucent reservoir having a coupling protruding a distance past the opaque housing, the opaque housing having a cavity defined by the shelled wall opposite the solid wall;

fixing a collar to the opaque housing, the collar retaining the translucent reservoir in the cavity, and receiving at least a portion of the coupling of the translucent reservoir; and attaching a stem of an application tip with the coupling of the translucent reservoir, such that the application tip is supported via the collar.

20. The method of claim 19, wherein the first material comprises terpolymer.

21. The method of claim 19, wherein the second material comprises terpolymer, polypropylene (PP), acrylonitrile butadiene styrene (ABS), or Styrene Acrylonitrile (SAN).

22. The method of claim 19, wherein the fixing of the collar to the opaque housing comprises ultrasonic welding of the collar to the opaque housing.

* * * * *